United States Patent [19]

Bernelov et al.

[11] Patent Number: 4,738,241

[45] Date of Patent: Apr. 19, 1988

[54] WOODBURNING STOVE WITH ECONOMIZER

[76] Inventors: J. Herman Bernelov, 2055 Camino De Los Robles, Menlo Park, Calif. 94025; Elsa I. Bernelov, 1904 Carmago Dr., San Jose, Calif. 95132

[21] Appl. No.: 839,937

[22] Filed: Mar. 17, 1986

[51] Int. Cl.[4] ..... F24B 7/00

[52] U.S. Cl. ..... 126/123; 126/70; 126/77

[58] Field of Search ..... 126/67, 72, 77, 58, 126/110 R, 110 A, 110 AA, 109, 99 R, 99 A, 121, 70, 71, 123

[56] References Cited

U.S. PATENT DOCUMENTS

| | | | |
|---|---|---|---|
| 2,328,030 | 8/1943 | Richards | 126/70 |
| 4,129,113 | 12/1978 | Bergstrom | 126/202 |
| 4,150,658 | 4/1979 | Woods | 126/72 |
| 4,166,444 | 9/1979 | Martenson | 126/123 |
| 4,250,867 | 2/1981 | Anderson et al. | 126/121 |
| 4,254,756 | 3/1981 | Wells | 126/121 |
| 4,254,757 | 3/1981 | Emmendorfer | 126/121 |
| 4,271,815 | 6/1981 | Johnson | 126/121 |
| 4,280,474 | 7/1981 | Ruegg, Sr. | 126/121 |
| 4,291,670 | 9/1981 | Hyatt | 126/131 |
| 4,305,373 | 12/1981 | Martenson | 126/123 |
| 4,319,558 | 3/1983 | Thurlo | 126/121 |
| 4,332,236 | 6/1982 | Stora et al. | 126/121 |
| 4,347,831 | 9/1982 | Graziano | 126/77 |
| 4,361,131 | 11/1982 | Hamolik | 126/77 |
| 4,372,286 | 2/1983 | Baker | 126/77 |
| 4,406,277 | 9/1983 | Russo | 126/77 |
| 4,441,481 | 4/1984 | Verhaegen | 126/121 |
| 4,441,482 | 4/1984 | Luscombe | 126/121 |
| 4,470,400 | 9/1984 | Fleisler | 126/77 |
| 4,519,376 | 5/1985 | Schoeff et al. | 126/121 |
| 4,520,791 | 6/1985 | Chamberlain | 126/121 |
| 4,545,360 | 10/1985 | Smith et al. | 126/77 |
| 4,549,522 | 10/1985 | Savignac | 126/72 |
| 4,583,516 | 4/1986 | Patterson | 126/121 |

*Primary Examiner*—Randall L. Green
*Assistant Examiner*—H. A. Odar
*Attorney, Agent, or Firm*—Richard C. Litman

[57] ABSTRACT

The efficiency of a wood burning stove is enhanced in a number of different ways. The first is a means to first preheat air in the lower part of the airspace in the jacket before the air passes through heat exchange tubes in the firebox. The second is to discharge the hot air in the upper part of the jacketed airspace along with the hot air from the heat exchange tubes into the enclosure to be heated. The third is to deflect the discharged hot air downward to decrease the temperature differential from floor to ceiling in the enclosure being heated. The fourth is to deflect the fire and hot gasses from the firebox away from the flue so that they must pass parallel in heat exchange relationship with the top of the stove before they can enter the flue. A fifth is to provide a second grate below the heat exchanger tubes, which act as a first grate, to catch burning embers which fall between the tubes of the first grate and provide complete combustion of the embers.

8 Claims, 3 Drawing Sheets

WOODBURNING STOVE WITH ECONOMIZER

BACKGROUND OF THE INVENTION

Woodburning stoves, either free standing or inserted into fireplace openings have, with the advent of high fossil fuel prices, become very popular. With the popularity has come more efficient wood stove designs. For example, U.S. Pat. Nos. 4,166,444; 4,214,569; 4,271,815; and 4,213,443 disclose heat exchange tubes through a stove, a heat exchange jacket around a firebox, and a flue baffle. Baffles above the fire box of a furnace are also shown in U.S. Pat. No. 4,319,557. All of these modifications shown by the prior art greatly enhance the amount of heat that can be extracted from a given quantity of fire wood.

SUMMARY OF THE INVENTION

The present invention is directed to further enhancing the efficiency of a wood burning stove. This is accomplished in a number of different though related ways. The first is a means to first preheat air in the lower part of the airspace in the jacket before the air passes through heat exchange tubes in the firebox. The second is to discharge the hot air in the upper part of the jacketed airspace along with the hot air from the heat exchange tubes into the enclosure to be heated. The third is to deflect the discharged hot air downward to decrease the temperature differential from floor to ceiling in the enclosure being heated. The fourth is to deflect the fire and hot gasses from the fire box away from the flue so that they must pass parallel in heat exchange relationship with the top of the stove before they can enter the flue. A fifth is to provide a grate under the heat exchange tubes, that comprises a second grate, to retain burning embers which fall between the tubes.

The above is accomplished using the following structure. A wood burning stove has a firebox, a jacket spaced from side, back, and upper surfaces of the firebox to define an airspace between the firebox and the jacket, at least one air inlet opening into the airspace, and multiple heat exchange tubes passing through the firebox from in front of and below the firebox rearwardly to the back of the fire box, then upwardly toward the top of the fire box then forwardly to air discharge openings. An extension of the airspace formed by the jacket is spaced from a lower front surface of the fire box. Air passageways from the airspace extension at the lower front of the firebox allows heated air to enter inlets to the multiple heat exchange tubes. Hot air outlet passageways from both the heat exchange tubes and the airspace allow hot air to enter ambient air at an upper frontal portion of the stove.

Air is blown into the airspace defined by the firebox wall and the stove jacket. A baffle with small restrictive air passageways through its wall separates the upper part of the air space from the lower and restricts the flow of air, through the airspace above the firebox to the air discharge openings communicating with ambient air at an upper frontal portion of the stove. The fire is laid directly on the heat exchange tubes and a grate is provided under the heat exchange tubes to catch burning embers which fall and allow for their complete combustion.

In order to reduce the amount of heat going up the flue, a flame deflector is positioned parallel to, above and spaced from the upper surfaces of the multiple heat exchange tubes, the deflector spreading the flame laterally, in order to increase heat transfer between the flame and the tubes. The deflector preferably has an area at least twice that of the area of the flue opening and is positioned parallel to and spaced from the flue opening. The deflector is preferably horizontal, and is so positioned and arranged so that flames are deflected to travel parallel to an upper surface of the firebox.

In order to prevent the hot air coming out of the stove from rising to the ceiling, an air deflector is positioned over the hot air discharge openings of the stove to direct discharged air downwardly.

DETAILED DESCRIPTION

Figure 1:
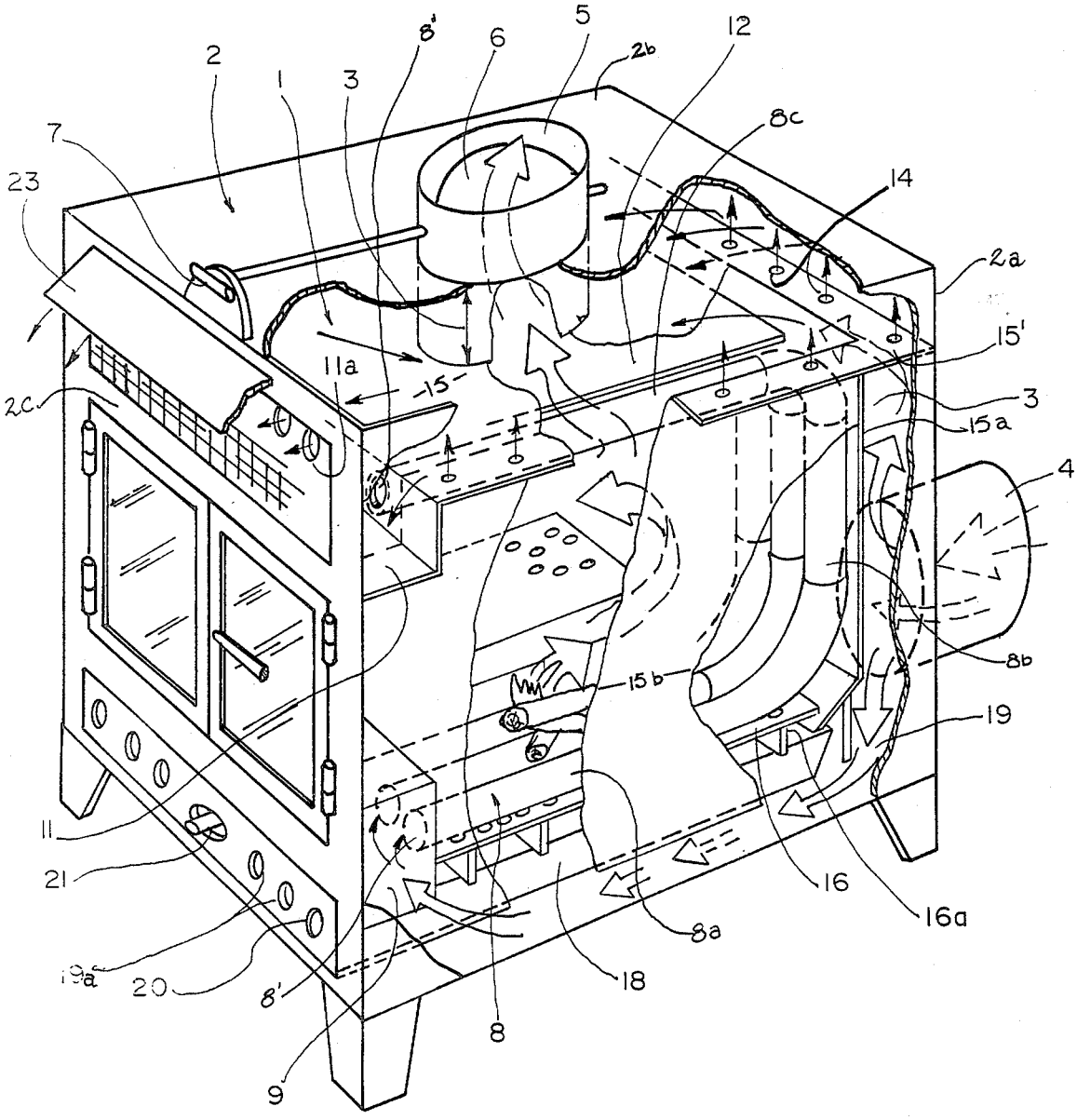
FIG. 1 is a perspective view, partially in section of a stove embodying the present invention.

Refering now to the drawings by reference characters, the stove or firebox of the present invention is generally designated 1 which is made of welded steel plates. The outer casing 2 is also made of fabricated steel. There is an airspace 3 between the firebox 1 and the outer casing 2. A blower 4 is placed outside the lower part of the rear wall **2*a* of the outer casing 2. A smoke outlet or flue 5 has in the top wall 2*b* of the outer casing a damper 6 which is adjustable by a regulator 7**.

Figure 2:
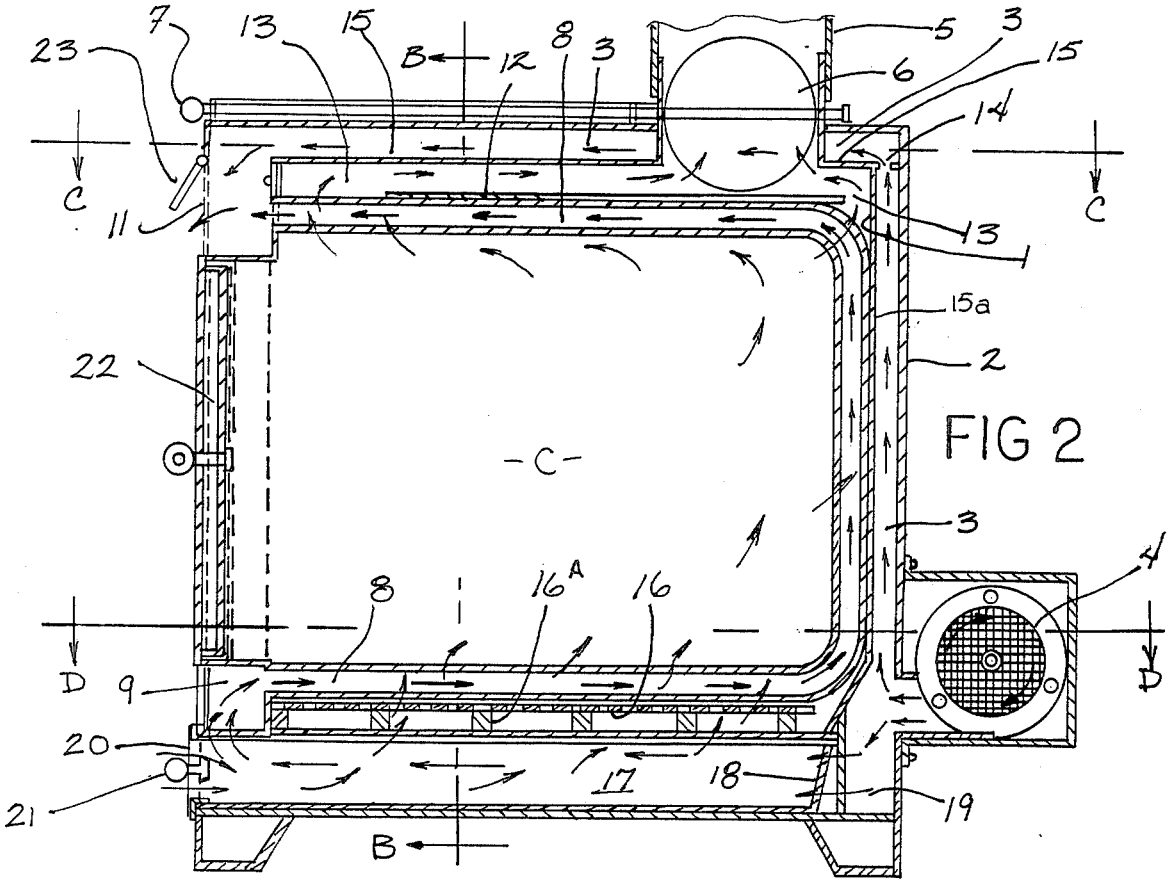
FIG. 2 is a cross sectional side view of the stove.
Figure 3:
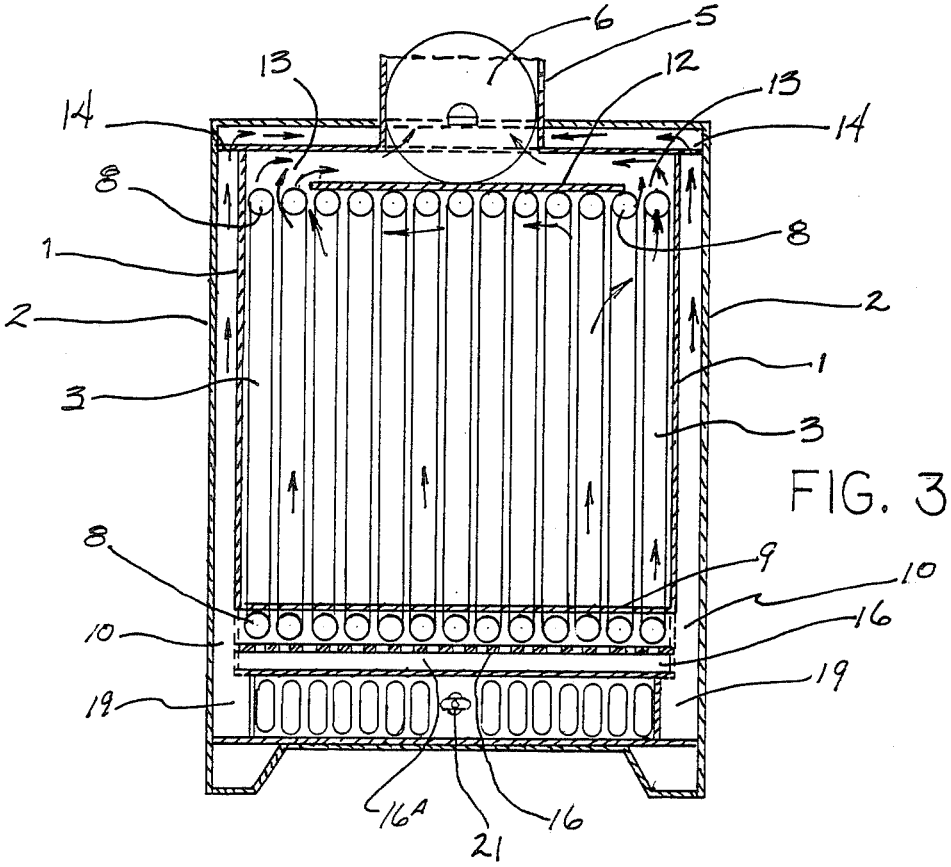
FIG. 3 is a front sectional view taken through B—B of FIG. 2.
Figure 5:
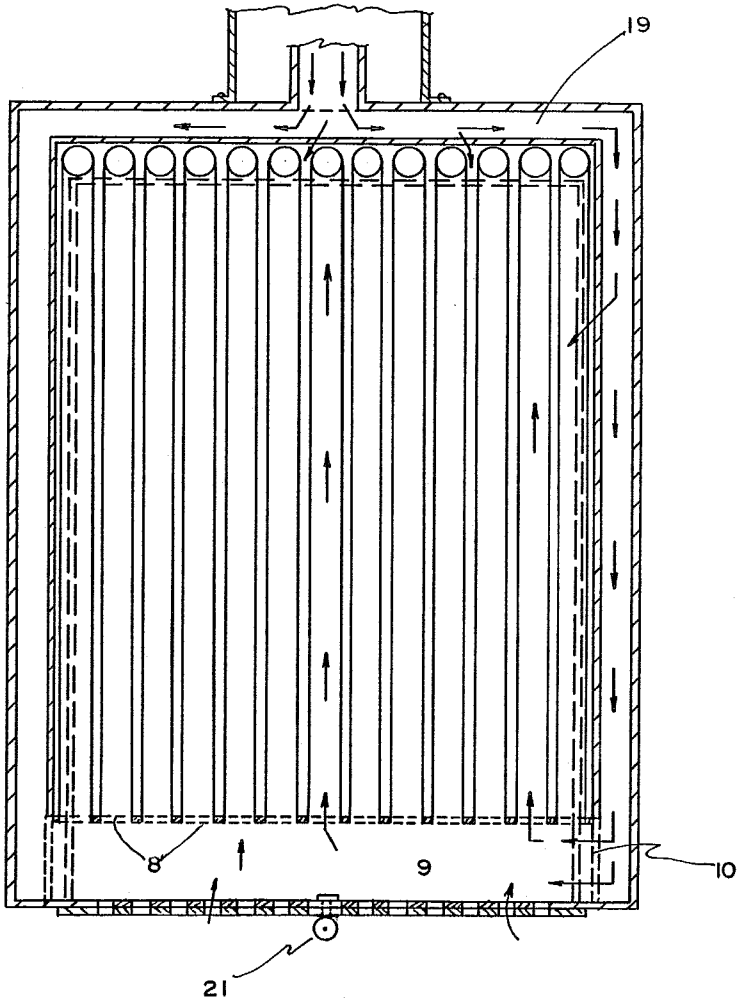
FIG. 5 is a bottom sectional view taken through D—D of FIG. 2.
Figure 4:
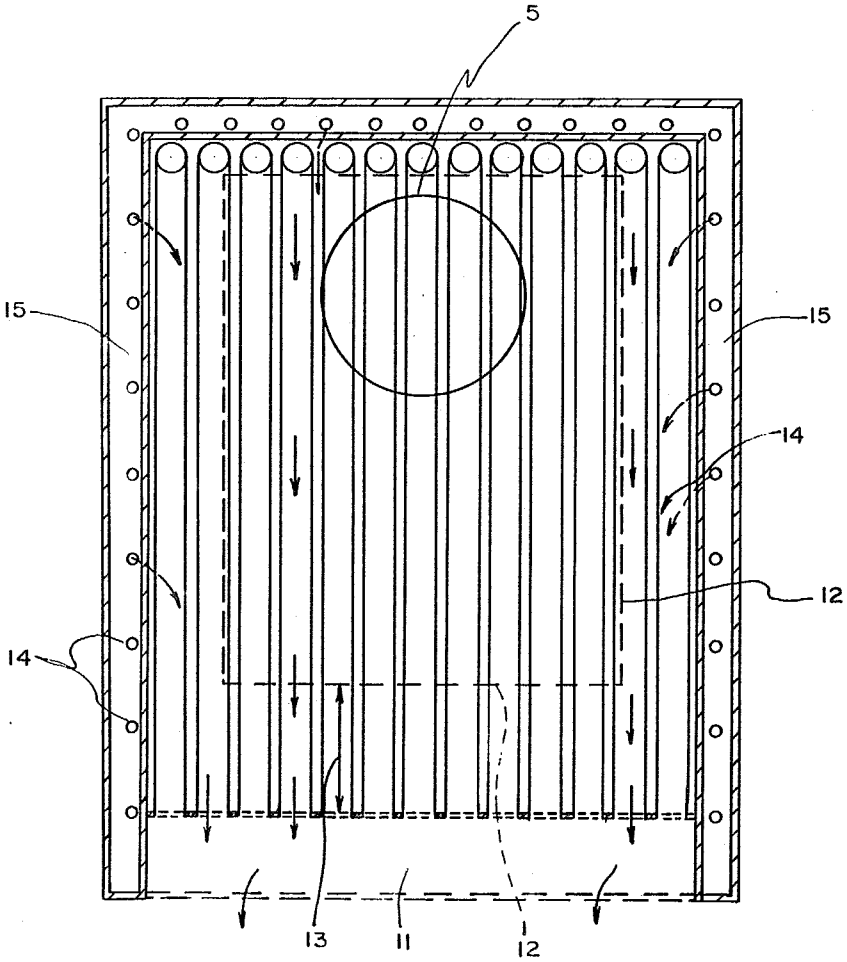
FIG. 4 is a top sectional view taken through C—C of FIG. 2.

Internally, a tubular manifold 8 leads from a transversely extending square inlet tube or chamber 9 which is an extension of air space 3 along the lower front of the stove. The generally C-shaped manifold 8, consisting of 13 closely spaced round heat exchange tubes originating at the square inlet tube. The bottom horizontal sections **8*a* run along the bottom area 10 of the firebox, thus creating a first fire gate. The tubes continue up the rear wall of the firebox as rear vertical sections 8*b* and then curve to run along the top of the firebox, as upper horizontal sections 8*c* and finally exit into a transverse warm air outlet 11 communicating with a plurality of discharge apertures 11*a* in the outer casing front wall 20. Each tube is provided with a lower inlet end 8' and an upper outlet end 8". An imperforate flame deflector 12 is located above the spaced apart upper sections 8*c* of manifold 8. Deflector 12 has sufficient space around its edges to let the smoke pass on its way to the outlet 5 as shown in FIGS. 1–3**.

The firebox rear wall **15*a* and side walls 15*b* will be seen to be spaced from the outer casing while the firebox top wall 15 is spaced beneath the casing top wall 2*b* to form the referenced airspace 3. A horizontal baffle 15' at the top of the rear and side walls 15*a*, 15*b* includes a plurality of small holes 14 allowing limited passage of air from the lower reaches of the airspace 3** to the top portion thereof.

Under the bottom part of the firebox as represented by the closely spaced heat exchanger bottom tube sections **8*a* there is located a second grate 16 comprising a perforated plate supported by steel bars or elements 16*a*. The second grate 16 catches burning embers which fall between the heat exchange tubes and provide an environment for continued, more complete combustion. Under the steel bars 16a is located an ash compartment with an ash drawer 18. The ash drawer 18 is attached to ash compartment door 20, into which the fireplace air regulator 21 is built, the latter serving to control admission of supply air through a plurality of air inlet openings 19a**.

An adjustable air deflector 23 is mounted in front of warm air outlet 11, to direct heated air from the discharge apertures 11a downwardly toward the floor of the associated enclosure.

A built-in stove is constructed the same way as the free standing stove, except that the blower is located next to the stove door. The built in stove protrudes 5 to 6 inches beyond the face of the masonry. The built in stove is fitted all around with sheet metal plates, like the free standing stove to create an airspace. Each of the two types of stoves has approximately 28 square feet of internal firebox surface.

FUNCTIONAL DESCRIPTION

Air blown by blower 4 enters air space 3 between firebox 1 and outer casing 2. Approximately 30% of the air passes through holes 14 in baffle 15 which holes 14 are intended to prevent all of the air from going directly over the top of firebox 1 and into manifold exit 11. The restrictive nature of the holes 14 force about 70% of the air entering the airspace 3 through air channels 19 communicating between the side airspaces 3 and the ends of the transverse inlet chamber 9 as shown most clearly in FIGS. 2 and 3. The air which has been preheated in air space 3 then enters the lower, front open ends of the manifold bottom section tubes 8a where it absorbs heat from wood burning in the combustion chamber C as the air moves through the heat exchanger tube sections 8a, 8b and 8c. Upon exiting the front, top openings of the tube sections 8c, the heated air; mixes with the air that passed through the ¼th inch baffle holes 14. The fire is laid directly on the first grate formed by manifold 8. The second grate 16, below the manifold grate, is designed to keep the embers from falling into the ash compartment as long as possible. The air supply into the firebox is regulated by the air regulator 21. The air flow is further regulated by the damper-air regulator 6 and 7. Thus the air flow and smoke can be adjusted properly.

The flame deflector 12 on top of the manifold at the top of the firebox prevents the flames from going directy out the flue by spreading the flames sideways between the manifold tubes in order that the tubes absorb maximum heat.

The adjustable warm air deflector 23 over the stove door is designed to direct the outgoing warm air toward the floor.

We claim:

1. A wood burning stove comprising, a firebox providing a combustion chamber and having top, rear and side walls, flue means through said top wall communicatiing with said combustion chamber, an outer casing having top, rear and side walls spaced from said firebox walls to define an airspace therebetween, fresh air inlet means opening into said airspace, a plurality of heat exchanger tubes within said firebox combustion chamber, said tubes including bottom horizontal sections, rear vertical sections and upper horizontal sections, said rear sections juxtaposed said rear firebox wall, said heat exchanger bottom horizontal sections defining a grate for supporting wood to be burned and each terminating in an open inlet end, a transverse inlet chamber spanning and communicating with said heat exchanger inlet ends, means to enable communication between said airspace and said inlet chamber at a point remote from said fresh air inlet means, additional fresh air inlet means adjacent to and communicating with said inlet chamber, said heat exchanger upper sections each terminating in an open outlet and, a transverse warm air outlet communicating with said heat exchanger tube outlet ends, and said airspace adjacent said casing top wall communicating with said transverse warm air outlet whereby, upon burning of wood on said grate, said combustion chamber is heated along with said tubes and airspace with a portion of the heated air in the airspace admixing with air drawn into said additional fresh air inlet means and this admixed air upon issuing into said transverse warm air outlet being admixed with warmed air exiting said airspace adjacent said casing top wall.

2. A wood burning stove according to claim 1 including, baffle means disposed intermediate said airspace that is juxtaposed said casing top wall and said airspace that is juxtaposed said casing rear and side walls, said baffle means restricting the amount of air entering said airspace from said fresh air inlet means and that communicates with said transverse warm air outlet.

3. A wood burning stove according to claim 1 wherein, said heat exchanger tubes are laterally spaced apart, an additional grate disposed beneath said heat exchanger bottom sections whereby, embers of burning wood falling between said spaced apart heat exchanger bottom sections repose upon said additional grate and continue to impart heat to said bottom sections.

4. A wood burning stove according to claim 1 including, a planar deflector plate intermediate said flue means and heat exchanger upper sections.

5. A wood burning stove according to claim 1 including, blower means connected to said fresh air inlet means.

6. A wood burning stove according to claim 1 including, an adjustable deflector member on said transverse warm air outlet.

7. A wood burning stove according to claim 2 wherein, said baffle means comprises perforated members whereby, the percentage of air from said fresh air inlet that reaches said transverse warm air outlet is substantially less than 50%.

8. A wood burning stove according to claim 3 wherein, said additional grate includes a perforated plate and a removable ash drawer beneath said additional grate.

* * * * *